United States Patent [19]

Shadowitz

[11] Patent Number: 4,969,064

[45] Date of Patent: Nov. 6, 1990

[54] APPARATUS WITH SUPERCONDUCTORS FOR PRODUCING INTENSE MAGNETIC FIELDS

[76] Inventor: Albert Shadowitz, Sun & Ski Village, Box 574, Wilmington, Vt. 05363

[21] Appl. No.: 311,756

[22] Filed: Feb. 17, 1989

[51] Int. Cl.[5] ..... H01F 7/22

[52] U.S. Cl. ..... 361/141; 335/216; 505/851

[58] Field of Search ..... 361/19, 139, 140, 141, 361/143, 146, 225, 268; 307/91, 104; 335/216; 324/318, 319, 320, 248; 323/360; 336/DIG. 1; 104/281–286; 505/842–846, 850, 851, 856, 870, 876, 879, 903

[56] References Cited

U.S. PATENT DOCUMENTS

| | | | |
|---|---|---|---|
| 3,227,930 | 1/1966 | Hnilicka, Jr. | 335/216 |
| 3,258,828 | 7/1966 | Swartz | 29/599 |
| 3,265,939 | 8/1966 | Rinderer | 335/216 |
| 3,281,737 | 10/1966 | Swartz | 335/216 |
| 3,283,277 | 11/1966 | Hulm et al. | 335/216 |
| 3,336,549 | 8/1967 | Kafka et al. | 335/216 |
| 3,363,207 | 1/1968 | Brechna | 335/216 |
| 3,391,362 | 7/1968 | Albrecht et al. | 335/216 |
| 3,470,508 | 9/1969 | Donadieu et al. | 335/216 |
| 3,486,146 | 12/1969 | Williams | 335/216 |
| 3,500,269 | 3/1970 | Katagiri et al. | 335/216 |
| 3,748,615 | 7/1973 | Bogner et al. | 336/60 |
| 3,766,502 | 10/1973 | Bronca et al. | 335/216 |
| 3,813,764 | 6/1974 | Tanaka et al. | 29/599 |
| 4,467,303 | 8/1984 | Laskaris | 335/216 |
| 4,468,646 | 8/1984 | Tada | 335/216 |
| 4,482,878 | 11/1984 | Burgeson et al. | 335/216 |
| 4,484,814 | 11/1984 | Kawaguchi et al. | 335/301 |
| 4,528,609 | 7/1985 | Purcell | 361/19 |
| 4,549,156 | 10/1985 | Mine et al. | 335/216 |
| 4,578,962 | 4/1986 | Dustmann | 62/505 |
| 4,586,017 | 4/1986 | Laskaris et al. | 338/32 |
| 4,599,592 | 7/1986 | Marsing | 335/216 |
| 4,622,531 | 11/1986 | Eyssa et al. | 335/216 |
| 4,651,117 | 3/1987 | Kawaguchi et al. | 335/216 |
| 4,727,734 | 2/1988 | Westphal et al. | 335/216 |
| 4,769,623 | 9/1988 | Marsing et al. | 335/216 |
| 4,783,628 | 11/1988 | Huson | 324/320 |
| 4,800,354 | 1/1989 | Laskaris | 335/216 |

*Primary Examiner*—A. D. Pellinen
*Assistant Examiner*—David Osborn
*Attorney, Agent, or Firm*—Lahive & Cockfield

[57] ABSTRACT

Apparatus for generating a magnetic field includes a superconducting coil winding and a conducting, non-magnetic electrical field member in proximity to and insulated from the winding. The winding is energized by a direct-current source, reaching a predetermined electrical potential when in the superconducting state. The electrical field member is held at a positive potential relative to the winding and the electrical field between the field member and the turns of the winding enables the winding to remain superconductive at current magnitudes exceeding the critical value that would have existed in the absence of such electrical field.

16 Claims, 3 Drawing Sheets

APPARATUS WITH SUPERCONDUCTORS FOR PRODUCING INTENSE MAGNETIC FIELDS

BACKGROUND OF THE INVENTION

This invention relates generally to apparatus for prOduCing intense magnetic fields having utility for experimentation (for example, in atomic particle acceleration and nuclear magnetic resonance) as well as for practical applications (such as magnetically levitated trains). More particularly, the invention relates to apparatus for increasing the current-carrying capabilities of superconductors and, thereby, the magnitude of the magnetic field that may be achieved.

When a magnetic field is generated by means of a helical winding or coil under non-superconductive conditions, there is ohmic resistance in the winding and heat is produced. The production of fields of greater magnitude under these conditions requires the circulation of coolants over the winding, and the costs associated with the use of such coolants and the need for replenishing them are large. In superconductivity the absence of ohmic resistance eliminates many problems associated with heat dissipation from the winding; there are, however other problems such as a limitation on the magnitude of the magnetic fields that can be safely achieved at feasible levels of cost.

A serious limitation to the widespread use of superconductivity has been the necessity to attain the extremely low temperatures required by available conductors to reach the superconductive state. In 1913 the highest critical temperature for superconductivity was approximately −269° C., the boiling point of helium. Now, further search has produced materials that can be superconductive at temperatures about 100° C. higher, opening the possibility for the use of much cheaper coolants such as liquid nitrogen.

Beyond the problems associated with achieving and maintaining sufficiently low temperature conditions for superconductivity however, further problems have limited the current levels and, therefore, the magnetic field that can be achieved in the central air core of a solenoid. In particular, it has been found that when the current density in a superconductor reaches a critical value, the superconductor suddenly reverts to a heat-producing, non-superconductive condition, creating the possibility of an explosion in a coil carrying a large current. This has given rise to a considerable development of the art associated with the configurations and the compositions of conductors for use as superconductors. In most cases the conductor construction is quite complex, and therefore expensive to fabricate.

It has been known for a number of years that, whereas a non-superconductive wire has a uniform current density throughout its cross section, a superconductive wire carries the current substantially entirely in the outermost shell of the cross section near, and just beneath, the surface. The current density is greatest within the cross section very near the surface, falling off essentiallY exponentially in the direction away from the surface to a penetration depth of approximately 1,000 angstrom units, or 100,000th of a centimeter, with some variation for different materials. Thus, for superconductivity the effective conductor cross section affecting the current density is much smaller than the actual conductor cross section.

In addition to a critical temperature and a critical current density there is a critical magnetic field at the surface of the superconductor itself; above this value the field-energizing winding reverts to ordinary conductivity.

SUMMARY OF THE INVENTION

A principal object of this invention is to enable magnetic-field-generating superconductors to carry currents at higher levels, without being limited by reason of reaching critical current densities formerly associated with reversion of the conductors to ordinary conductivity.

A second object is to provide means that substantially alter the distribution of electrical current along wires forming a superconductive field-generating-winding, and thereby to produce a fundamental change in the effect of current density on superconductivity.

A third object is to enable the conductors to remain superconducting even when they are located in magnetic fields, for example fields produced by other wires or layers of a coil, which are larger than the critical magnetic fields ordinarily destructive of the superconductivity. This is of particular importance in multilayer coils.

A fourth object is to secure a higher attainable value of magnetic field without incurring the high cost of complicated conductor fabrication associated with prior art methods.

With the foregoing and other objects hereinafter appearing in view, a principal feature of this invention consists in apparatus for creating an electrical field, external to the superconductor, having lines terminating at the surface of the superconductor.

A second feature comprises apparatus including a conducting, nonmagnetic electrical field member in proximity to and insulated from the magnetic field generating superconductor, whereby the field member and the superconductor effectively comprise a capacitor charged by a direct current source.

A further feature is that under the influence of the electric field extending between the conducting nonmagnetic field member and the superconductor, the negative Cooper-pair charges constituting the carriers of the supercurrent flow directly upon the surface of the superconductor and not within such surface.

The foregoing and other features of the invention will be more clearly understood from the following description of the presently preferred embodiment and alternative forms.

DRAWINGS

DETAILED DESCRIPTION

Figure 1:
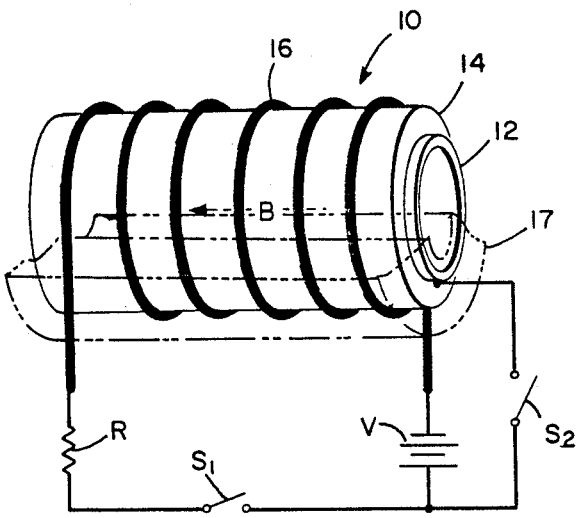
FIG. 1 is a partially schematic drawing of the presently preferred embodiment of the invention in a simple form, the electrical field member comprising a cylindrical shell.

FIG. 1 shows apparatus depicted generally at 10, for producing an intense magnetic field B within the interior of a tubular structure according to this invention. The structure comprises a conducting nonmagnetic electrical field member in the form of a cylindrical shell 12, a layer 14 of insulating material and a helical winding 16 comprising many closely wound turns of metal or other electrically conductive wire. Reference numeral 17 depicts a typical structure (shown diagrammatically and partially broken away) for maintaining the winding 16 at a superconductive temperature, and any suitable known apparatus may be employed for this purpose. For simplicity of description the structure 17 has been omitted from the drawings of the other embodiments herein described. The winding is energized by a source V of direct-current, the source and the winding being in series with a resistance R. In any case, the source V must have means to limit the magnitude of its delivered current, and if it is not a constant-current source, the resistance R is used to limit the magnitude of the current when the winding is superconducting. A switch S1 completes the energizing circuit. When the switch S1 is open the entire winding 16 is at the electrical potential of the negative terminal of the source V. In accordance with this invention a circuit connects the positive terminal of the source V with the shell 12. As shown, the connection is through a switch S2 which is shown in the drawing for purposes of the following explanation. However, the switch S2 is not a necessary part of the invention and the positive terminal of the source V may be connected directly to the shell 12.

For purposes of explanation, let it first be assumed that the switch S2 is open, in which case the apparatus operates in the manner previously observed in the art. If the winding 16 is at a temperature below the critical value for superconductivity and the switch S1 is then closed, the absence of ohmic resistance results in all of the turns of the winding remaining at the same electrical potential, namely that of the negative terminal of the source V, and a supercurrent flows through the winding. To obtain higher values of B in the central core region of the solenoid one may either increase the voltage V of the source, or decrease the resistance R, or do both.

In any case, if the turns of the coil consist of a superconducting material such as tin, lead or aluminum uniformly distributed throughout the cross section of the wire, it has been observed that there are maximum values of current and magnetic field at which the coil remains superconducting. If it is attempted to increase the current to exceed these values the material becomes a normal conductor, producing heat and adding resistance in series; the current and the field actually decrease.

Hitherto, a widely-used method of increasing the value of the attainable field with super-conducting wire has employed a conductor consisting of a multitude of small diameter filaments of superconducting material embedded in a matrix of normal (nonsuperconducting) metal. This has the additional advantage of providing a means for the rapid dissipation of heat in the event that hot spots in the circuit are produced in operation. However, such conductors are very expensive to fabricate.

Figure 2:
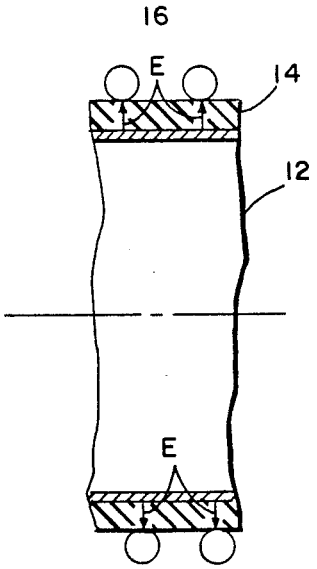
FIG. 2 is a fragmentary longitudinal cross section of the embodiment of FIG. 1 under conditions illustrative of the present invention.

Let it next be assumed that the switch S2 is closed with the switch S1 open. This connects the positive terminal of the source V with the conducting, nonmagnetic shell 12, but no continuous current flows through this connection. There is a very brief transient current flow lasting only microseconds, after which the shell 12 will have assumed the electrical potential of the positive terminal of the source V. The shell and the turns of the winding 16 become, in effect, the plates of a cylindrical capacitor. FIG. 2 illustrates the electric field lines E that extend between the surface of the shell 12 and the surfaces of the winding.

If the winding 16 is at a temperature below the critical value for superconductivity and the switch S1 is then closed, the absence of ohmic resistance results in all of the turns of the winding remaining at the electrical potential of the negative terminal of the source V, and a supercurrent flows through the winding. However, with the switch S2 now closed it is found that the current and the magnetic field may be increased above the maximum values observed in the previously assumed case where the switch S2 was open, without the loss of superconductivity.

Figure 3:
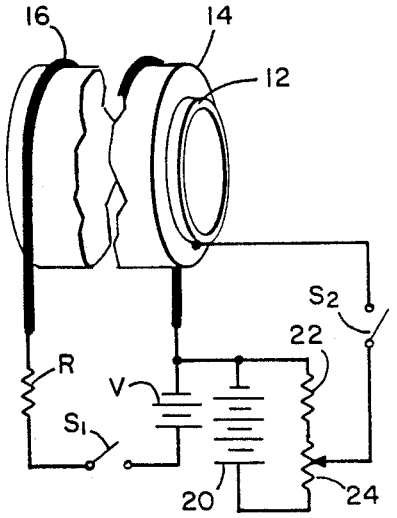
FIG. 3 is a drawing showing an alternative circuit for generating the electric field between the conducting nonmagnetic shell and the winding.

FIG. 3 illustrates an alternative to the embodiment of FIG. 1 showing a different means for applying an electrical potential to the shell 12. In this drawing like elements have the same reference numerals as the elements of FIG. 1. Here, a source 20 of direct-current voltage is connected in series with a resistor 22 and a potentiometer 24. This circuit is connected with the terminal of the source V that establishes the potential of the winding 16 when it is superconductive, and establishes a variable potential on the shell 12 that is positive with respect to that of the winding, thus establishing electrical field lines E having the polarities illustrated in FIG. 2. The resistor 22 establishes the lower limit of the potential difference between the shell 12 and the winding 16, and the voltage of the source 20 establishes the upper limit.

An explanation for the above-described operation of the invention follows. Referring to FIG. 1, assume first that the switch S2 is open and the switch S1 is closed with the winding 16 at a temperature below the critical level for superconductivity.

In this case, the apparatus operates in the manner previously observed in the art. Current will flow in the interior portion of the cross section of the winding 16, specifically as illustrated by the blackened portion of such cross section in FIG. 4 closest to the shell 12. This differs from the case of a normally resistive conducting wire in which the current would be distributed uniformly throughout the cross section, and it also differs from the case of a superconducting straight wire in which the current would flow essentially in a narrow shell all around the wire and just within its surface to a penetration depth of roughly 1,000 angstrom units, for all known superconductors. The current flow is entirely within the surface of the wire.

Figure 4:
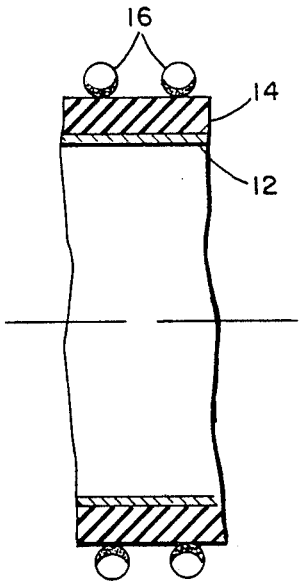
FIG. 4 is a fragmentary longitudinal cross section of the embodiment of FIG. 1 under certain conditions of operation, for purposes of explanation.
Figure 5:
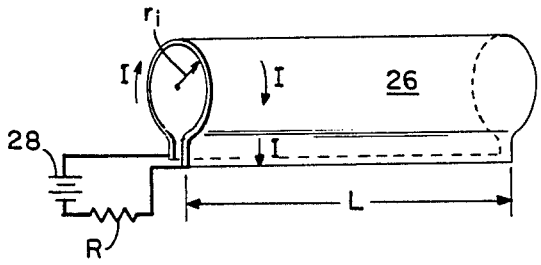
FIG. 5 is a drawing of a single turn sheet conductor, for purposes of explanation.

The concentration of the current flow as shown in FIG. 4 may be quantified to an approximation by considering the alternative form of a thick, single turn, solid sheet superconductor 26 of length L as illustrated in FIG. 5. The sheet forms almost one complete single turn, with a gap that is small relative to the circumference The sheet has a radius $r_i$ from the central axis to its inner surface. A source 28 of direct-current produces a current I flowing annularly in the direction shown by the arrows. Since the sheet is superconducting the current flows only in that portion of the sheet that is within its thickness and just outside the inner radius $r_i$. For this simplified case it can be shown mathematically that, assuming that $r_i$ is very much greater than the penetration depth of the current below the inner surface of the sheet, the current density decays essentially exponentially from its maximum value at the inner surface of the sheet.

In a very short distance in the direction radially outwardly from the axis but inwardly into the material of the sheet, the value of the current density drops essentially to zero. A similar behavior of the current density with respect to the radius from the axis of the winding must occur in the case of a winding or solenoid of many turns; however the latter case is more complicated because the individual turns produce a scalloped effect as illustrated by FIG. 4.

In contrast to current flow in normal conductors where conduction is by electron carriers, with superconductivity conduction is by Cooper pairs, i.e. temporary, evanescent pseudoparticles formed by pairs of electrons which are within a coherence range $\xi$ of each other, each pseudoparticle having a charge Q of value $$Q=2e=2(-1.6\times10^{-19})\text{ coulomb.} \qquad ()$$

The current density within the wire may be described by the following relationship.

$$J=nQv \qquad (2)$$

where J is the current density in amperes per square meter, n is the number density of Cooper pairs per meters to the third power, and v is the speed of the Cooper pairs in meters per second. As the current is increased, either by increasing the voltage of the source V or by decreasing the resistance R, the speed v increases.

Figure 6:
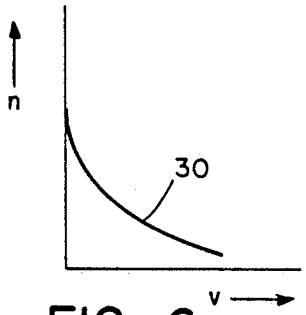
FIG. 6 is a curve showing the variation of the number density of Cooper pairs on the winding as a function of their speed according to the prior art.

In contrast to current flow in normal conductors where the number density n of the electron carriers remains constant as the electron drift velocity increases, with superconductivity within the interior, just beneath the surface, the value of n decreases as v increases, as shown by the curve 30 in FIG. 6. This is explained by the fact that as the speed of the Cooper pairs increases, the time during which their individual electron constituents are within the coherence range $\xi$ of each other decreases, causing the Cooper pairs to dissolve more quickly and n to decrease in value. The effect of the decrease of n with increasing v on the value of J is shown by the solid curve 32 in FIG. 7, namely, that as v increases J deviates from the linear relationship shown by the broken line 34 until at a critical value $v_c$ the value of J reaches a maximum or critical value $J_c$ where the tangent to the curve is horizontal and J can no longer increase. At the critical current density $J_c$ the winding reverts to an ordinary conductive state and exhibits ohmic resistance.

Figure 7:
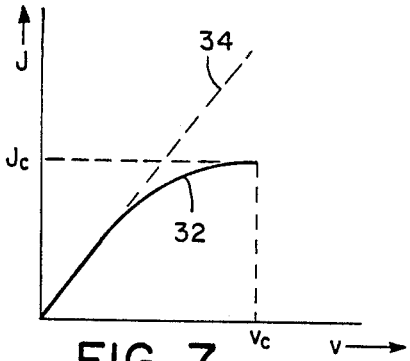
FIG. 7 is a curve showing the variation of the current density in the winding as a function of the speed according to the prior art.

By similar reasoning it may also be stated that in the foregoing prior art case the total current flowing through the winding is related to the velocity v by a function similar to the solid curve 32 in FIG. 7, because the total current is related to the current density J by an essentially constant factor.

It will also be evident that in this assumed prior art case the limitation of the maximum value of the total current limits the maximum value of the field B that is attainable.

In FIG. 1, next consider the case in which the switch S1 is open and the switch S2 is closed. As previously stated, an electrical field is established between the shell 12 and the winding 16. As is well known, the electric field lines E (FIG. 2) originate on the outer surface of the body 12 at positive potential and terminate on the inwardly facing surfaces of the turns of the winding 16 at negative potential. Such field lines cannot extend into the interior portions of either the shell 12 or the individual turns of the winding since these bodies are electrically conducting, and internal currents would immediately short circuit and destroy any electrical potential differences between points on such lines within these bodies.

On the shell 12 the lines begin on positive charges, namely the stationary positive ions that remain when the outer electrons in a normal conductor move away from otherwise neutral atoms of the conductive material. On the wires comprising the turns of the winding 16 the lines E terminate on negative charges; these may comprise either electrons which have left the atoms of the conductive material or Cooper pairs. The negative potential of the winding 16 with respect to the shell 12 is created by the movement of these negative charges to the surface of the wires from the source V, charging the winding-shell capacitor. In the assumed case, although these electrons or Cooper pairs may be moving, they do so in random directions and may be considered to be at rest. Therefore, as long as the switch S1 remains open the lines E may be considered to begin and terminate on stationary electric charges.

In FIG. 1, with the switch S2 closed as described above, closure of the switch S1 with the winding 16 in a superconductive state does not change the electric field as described above, in that electrical field lines E of the same intensity continue to originate on positive ions on the surface of the shell 12 and extend to the surface of the turns of the winding 16. On the negatively charged surface of the turns of the helix the lines terminate only on Cooper pairs constituting the supercurrent and flowing on the surface of the wire rather than in the interior body thereof.

As shown by A. Shadowitz in Physica, Volume 49 at page 141 (1970), the transient condition produced by the initiation of supercurrent in a transmission line, terminated by a direct-current source V at one end and a resistor R at the other end, squeezes together the Cooper pairs in that part of the line connected to the negative terminal of the source and spreads them apart in that part of the line connected to the positive terminal of the source. This is the mechanism by which one line becomes negatively charged and the other positively charged. The presence of the electric field E between the two halves of the transmission line, perpendicular to the wires, forces the Cooper pairs flowing on the negatively charged superconductor to flow on the surface rather than just underneath the surface; for the lines of the field E, which cannot extend into the interior, must terminate on the Cooper pairs and not on the individual electrons—a condition established by the transient waves which established the steady state. On the other hand, the Cooper pairs flowing on the positively charged member may flow either on or within the surface; for here the lines of the field E commence at stationary positive ions on the surface. Further, the energy requirement for current flow within the surface is identical with that for flow on the surface. It is for this reason that the negative terminal of the power supply is connected to the coil winding and the positive terminal is connected to the cylindrical shell.

When the switch S1 of FIG. 1 was closed, the negative electrical potential of the winding was created by the Cooper pair carriers of the supercurrent, the density of which exceeded the density of the positive ions on the surface. The Cooper pairs were squeezed together in a manner similar to that described in the above reference, these Cooper pairs being supplied by the source V. The presence the electric field controls, and renders constant, the total number of Cooper pairs on the winding, and therefore substantially fixes the value of nQ in equation (2) independently of the value of v, so that J has a substantially linear relationship to v. This is shown as follows. The electric field establishes the relationship $$Q=CV \tag{3}$$

where Q is the magnitude of the net charge in coulombs on each of the shell and winding, C is the capacitance in farads and V is the potential difference in volts between the terminals of the source. Let $$\beta=v/c \tag{4}$$

where c is the speed of electromagnetic radiation. The net charge Q of the winding is the magnitude of the difference between the charge $Q_p$ of the positive ions on the surface of the winding and the negative charge $Q_n$ of the Cooper pairs on that surface, the latter being related to the positive charge by the expression $$Q_n=-Q_p/(1-\beta) \tag{5}$$

This equation holds for the negatively charged member; a slightly different equation holds for the positive member. The current is given by $$I=|Q_n|v=[1/(1-\beta)]Q_p v \tag{6}$$

The function within brackets in equation (6) is very nearly constant for the very small values of $\beta$ that occur in practice. Therefore, I is a very nearly linear function of v, and is in the form represented by the broken line 34 in FIG. 7. For this reason there is no critical current of the usual kind here, and no reversion of the superconductor to an ordinary conductive state.

Figure 8:
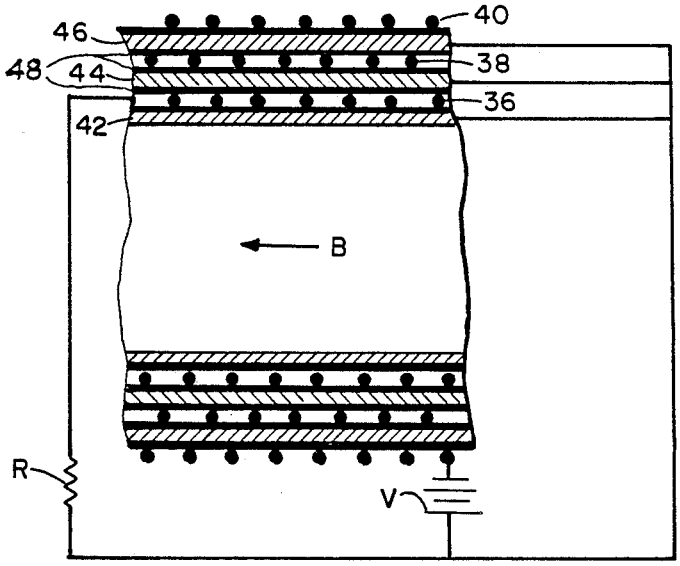
FIG. 8 illustrates an embodiment having a winding comprising a plurality of superposed layers of coils.

FIG. 8 illustrates an embodiment of the invention in which the magnetic-field-generating winding comprises a plurality of superposed layers of helically wound coils 36, 38 and 40 connected electrically either in parallel or in series. A plurality of concentric, cylindrical, electrically conducting, non-magnetic shells 42, 44 and 46 are arranged alternately with the layers of coils as viewed in the longitudinal cross section of FIG. 8, with cylindrical layers 48 of insulation separating the shells and coils.

As shown, the layers of coils are connected in series, the connections being such as to cause the currents in the coils 36, 38 and 40 to be additive with respect to the magnetic field B.

In this embodiment the shells 42, 44 and 46 are all connected together and to the positive terminal of a source V. Alternatively, the shells may be individually connected to sources of differing positive potential with respect to the windings.

Figure 9:
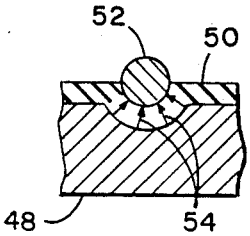
FIG. 9 illustrates an embodiment having a grooved shell.
Figure 10:
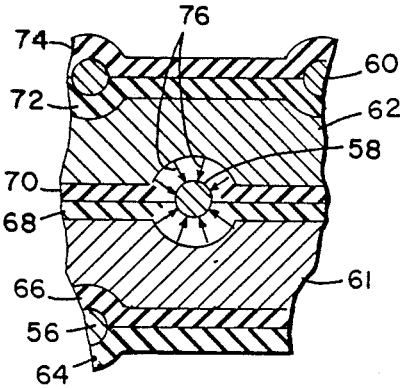
FIG. 10 illustrates an embodiment having a plurality of grooved shells.

It will be understood that although the conductive, non-magnetic shells in the embodiments of FIGS. 1, 3 and 8 are shown as metallic cylinders, they may be fabricated in other convenient forms. For example, the shells may be fabricated of woven wire mesh in a cylindrical configuration, or cylindrical shells may have grooved surfaces formed as shown in FIGS. 9 or 10. FIG. 9 illustrates a variant of the embodiment in FIG. 1, comprising a peripherally grooved shell 48, an insulating sleeve 50 and a winding 52 nested in grooves in the insulator 50. This arrangement produces electrical field lines 54 extending normally to the winding over a larger portion of the circumferential surface of the wire, as compared with the embodiment in FIG. 1. FIG. 10 illustrates a variant of the embodiment in FIG. 9, comprising a plurality of superposed layers of coils 56, 58 and 60, a plurality of grooved metallic shells 61 and 62 and insulating sleeves 64, 66, 68, 70, 72 and 74. With this arrangement electrical field lines 76 extend to the turns of the winding 58 over substantially their entire circumference.

Figure 11:
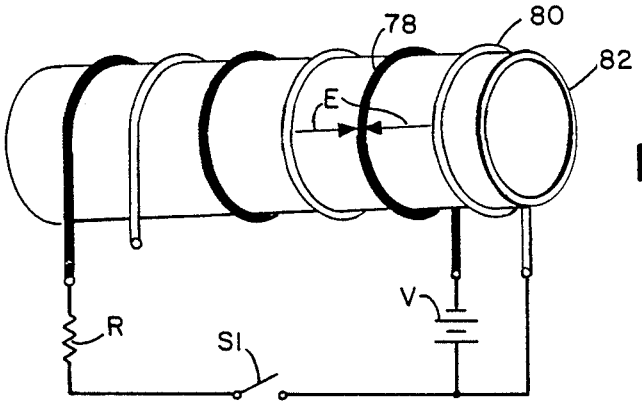
FIG. 11 illustrates an embodiment in which the electrical field member comprises a second winding.
Figure 12:
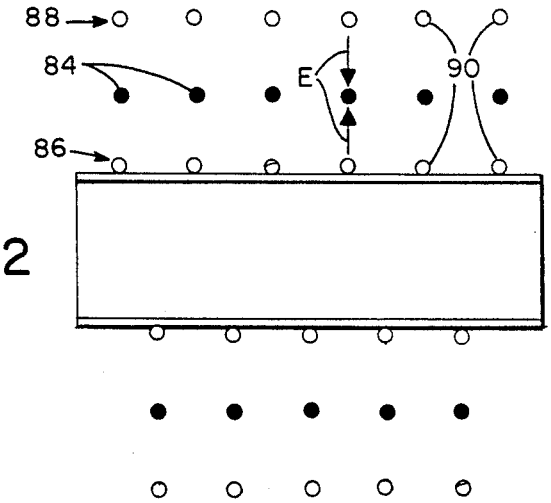
FIGS. 12 and 13 illustrate variations of the embodiment of FIG. 11 in which the windings comprise a plurality of interposed layers or turns.
Figure 13:
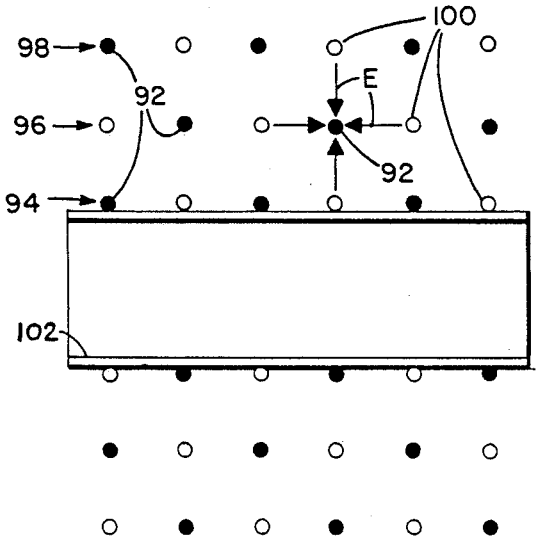

FIGS. 11, 12 and 13 illustrate embodiments in which the electrical field member is in the form of one or more windings. In FIG. 11 a helical magnetic-field-generating winding 78 is connected to the negative terminal of the source V and one end of a second helical winding 80 is connected to the positive terminal of the source. The other end of the winding 80 is not connected. The windings are conveniently supported on an insulating form 82 and comprise a single layer with the turns of the two windings alternately interposed. The electric field lines E extend to each turn of the winding 78 in two directions parallel to the axis of the helix as shown, rather than in one direction perpendicular thereto as in FIG. 2.

FIG. 12 illustrates an embodiment having a single layer helical magnetic-field-generating winding 84 which may be connected to an energizing circuit in the same manner as the winding 78 in FIG. 11, although in this case all adjacent turns are part of the same coil. The electrical field member of this embodiment comprises two layers 86 and 88 of a second winding 90 these layers being respectively internal and external to the winding 84. The winding 90 is connected to the positive terminal of the source in the same manner as the winding 80 in FIG. 11. In this case the electric field lines E extend to each turn of the winding 84 in two directions perpendicular to the axis of the helix. The structure may be built up with additional alternating layers in a like manner.

FIG. 13 illustrates an embodiment having the features of both of FIGS. 11 and 12. A magnetic-field-generating winding 92, energized in the same manner as the winding 78 in FIG. 11, comprises a plurality of coaxial overlying layers 94, 96 and 98. Interposed between the turns in each layer are turns of a second winding 100 connected to the positive terminal of the source in the same manner as the winding 80 in FIG. 11. In this case the electric field lines E extend to each turn of the winding 92 in two directions parallel to the axis of the helix and two directions perpendicular to the axis. The windings are conveniently supported on an insulating cylindrical form 102.

For simplicity in the description, the embodiments of the invention shown and described herein have helical windings, that is, windings with adjacent turns spaced axially. However, it will be apparent that in some cases adjacent turns may be spaced radially or in a sequence of axial and radial spacing by any suitable known procedure for forming coil windings.

It will also be observed that according to this invention the magnetic field generator may be a coil or coils with their turns in series as in the described embodiments, or a plurality of individual annular coil turns with all of the turns connected in parallel, or a single-turn tube as in the embodiment of FIG. 5, which eliminates the necessity for insulation between individual turns. The embodiments incorporating a coil winding are preferred because they require a smaller supercurrent to produce a magnetic field of given magnitude. Because of the proximity of the electrical field member to the magnetic field generator winding, it is contemplated that in many instances the electrical field member will itself be at a superconductive temperature as shown in FIG. 1. In any case the materials forming the structure 17 are chosen to be suitable for the purposes hereinabove described.

I claim:

1. Apparatus for producing a magnetic field in combination with an electric field comprising, in combination, an electrically conducting magnetic field generator of generally tubular form having terminals arranged for conducting annular current flow to produce an axially directed magnetic field therethrough, means to maintain the generator at a superconductive temperature, a direct current source having means to limit the magnitude of its delivered current, a circuit connecting the generator and source in series, an electrical field member of generally tubular form, generally coaxial with the generator and comprising conducting, non-magnetic material in proximity to and insulated from the current conducting portions of the generator, and means for maintaining the electrical field member at a positive electrical potential relative to said portions of the generator.

2. Apparatus according to claim 1, in which the magnetic field generator is a coil winding.

3. Apparatus according to claim 1, in which the negative terminal of the source is connected to a terminal of the generator.

4. Apparatus according to claim 3, in which the direct current source includes a resistor in series therewith.

5. Apparatus according to claim 4, including a connection between the electrical field member and a point in said circuit having a more positive potential than that of the generator.

6. Apparatus according to claim 1, in which the last-mentioned means comprise a second direct current source having its negative terminal connected to a terminal of the generator, a potentiometer connected across said second source, and a connection from the electrical field member to the variable terminal of the potentiometer.

7. Apparatus according to claim 1, in which the electrical field member is maintained at a superconductive temperature.

8. Apparatus according to claim 2, in which the electrical field member comprises a shell of tubular shape.

9. Apparatus according to claim 8, in which the shell is grooved and the winding has turns nested in the grooves of the shell.

10. Apparatus according to claim 2, in which the winding comprises a plurality of superposed layers of coils and the electrical field member comprises a concentric shell separating each pair of adjacent layers.

11. Apparatus according to claim 10, in which the shells are grooved and at least one of said layers has turns nested in a pair of said shells.

12. Apparatus according to claim 2, in which the electrical field member comprises a second winding having turns between the turns of the magnetic field generator winding.

13. Apparatus according to claim 12, in which all of the turns of the second winding are at substantially the same electrical potential.

14. Apparatus according to claim 10, in which the magnetic fields generated by said coils are additive.

15. Apparatus according to claim 12, in which the magnetic field generator and second windings each comprise a plurality of superposed layers of coils.

16. Apparatus according to claim 15, in which the turns of the magnetic field generator and second windings alternate within said layers.

* * * * *

UNITED STATES PATENT AND TRADEMARK OFFICE

CERTIFICATE OF CORRECTION

PATENT NO. : 4,969,064

DATED : November 6, 1990

INVENTOR(S) : Albert Shadowitz

It is certified that error appears in the above-identified patent and that said Letters Patent is hereby corrected as shown below:

Column 1, lines 6 and 7, cancel "prOduCing" and substitute --producing--; line 60, cancel "essentiallY" and substitute --essentially--

Column 5, line 37, cancel "()" and substitute --(1)--

Signed and Sealed this

Thirty-first Day of March, 1992

*Attest:*

HARRY F. MANBECK, JR.

*Attesting Officer*

*Commissioner of Patents and Trademarks*